United States Patent [19]

Paulhac

[11] Patent Number: 4,805,432

[45] Date of Patent: Feb. 21, 1989

[54] DEVICE FOR AXIALLY SUPPORTING A ROLLER

[75] Inventor: René Paulhac, Sorbiers, France

[73] Assignee: Clecim S. A., Courbevoie, France

[21] Appl. No.: 25,116

[22] Filed: Mar. 12, 1987

[30] Foreign Application Priority Data

Mar. 12, 1986 [FR] France ..... 86 03530

[51] Int. Cl.[4] ..... B21D 1/02

[52] U.S. Cl. ..... 72/164; 29/116.1; 384/454; 384/610

[58] Field of Search ..... 72/163, 164, 165; 384/454, 610; 29/116 R

[56] References Cited

U.S. PATENT DOCUMENTS

| | | | |
|---|---|---|---|
| 2,063787 | 12/1936 | Brown | 384/610 |
| 2,606,084 | 8/1952 | Larsen et al. | 384/610 X |
| 3,655,226 | 4/1972 | Cowan | 384/610 X |
| 4,106,192 | 8/1978 | Stahlecker | 384/610 |
| 4,597,678 | 7/1986 | Angelbeck et al. | 384/610 X |

*Primary Examiner*—Robert L. Spruill
*Assistant Examiner*—Steven B. Katz
*Attorney, Agent, or Firm*—Pollock, Vande Sande & Priddy

[57] ABSTRACT

A device for axially supporting a rotating roller (1) resting axially on a fixed frame, at each end, by a contact ball bearing (3). According to the invention, the contact ball bearing (3) is mounted on the end of a support piece (5) consisting of a cylindrical insert (51) extended, on the roller side, by an enlarged base piece (52), fitting inside a recess (6) and bearing, in the axial direction, against the end wall (62) of the recess (6), by an axial bearing (66) and, in the radial direction, against the side wall (61) of the recess (6), by a rolling bearing (65) centering the insert (51) about the axis of rotation (10), the assembly being held in position by a cap (7) closing the recess (6).

5 Claims, 1 Drawing Sheet

DEVICE FOR AXIALLY SUPPORTING A ROLLER

FIELD OF THE INVENTION

The invention relates to a device for axially supporting a roller mounted for rotation about its axis in a fixed frame.

BACKGROUND OF THE INVENTION

In certain applications, for example in devices for continuously levelling metal strips, use is made of rollers which revolve about an axis, but which cannot, for various reasons, be fixed onto bearings designed to hold them in position, because they must have a degree of freedom in the axial direction and must merely be supported radially in their working position. Such a roller is therefore mounted so as to rest on roller wheels or on a support roller and its rotating shaft is equipped, at its ends, with axial bearings which come into contact in both directions with bearing plates mounted on the support frame, depending on the axial stresses exerted in various directions during operation. Normally, each bearing consists of a ball mounted at one end of the rotating shaft of the roller and capable of applying pressure against a suitably shaped wear plate mounted in the desired position on the frame. The ball revolves together with the roller when it is not exerting pressure, but stops very rapidly when it comes into contact with the wear plate. It is therefore fixed onto a support mounted rotatively about the axis of rotation, at the end of the shaft. The devices used for this purpose until now have proved satisfactory for speeds of up to 3500 rpm. However, it has now become necessary to consider much higher speeds of rotation, of the order of 10 to 12,000 rpm, and the inertia of the revolving support is, in such cases, too great to allow it, under favorable conditions, to stop rotating when the ball comes into contact with the frame.

SUMMARY OF THE INVENTION

The invention relates to a new axial support device in which, owing to a special arrangement, it is possible to minimize the inertia of the rotating parts and provide a bearing surface in the form of a ball with a small diameter, reducing the heating resulting from friction during contact with the bearing plates, and therefore achieve very high speeds of rotation during operation.

According to the invention, at each end of the roller shaft, the ball bearing is mounted on the end of a support piece. The support piece consists of an insert which is limited laterally by a cylindrical surface comprising a shoulder delimiting, on the roller side, a base piece with an enlarged cross section located inside a recess provided at the end of the roller, and limited, on the roller side, by a transverse end wall and, on its periphery, by a cylindrical side wall. The said enlarged base piece bears, in the axial direction, against the bottom of the recess, by means of an axial bearing and, in the transverse direction, against the side wall of the recess, by means of a rolling bearing centering the insert about the axis of rotation. The assembly is held in place by a cap closing the recess, this cap being fixed onto the side wall of the latter and comprising a flat end wall provided with an orifice through which the insert passes and bearing, in the axial direction, against the shoulder of the side surface of the insert.

Advantageously, the rolling bearing centering the enlarged base piece and located on the side wall of the recess is a needle roller bearing.

Moreover, since the roller is not supported by bearings, but rests radially, usually on another roller, its axis of rotation may be displaced slightly, parallel to itself, inside the fixed frame, as a result of wear of the external casing of the roller. In this case, there is a risk that the ball bearing of the roller will not remain centered in relation to the wear component located on the frame. According to a preferred arrangement, the device comprises a means for adjusting the position of the wear component on the frame, in accordance with the position of the axis of rotation. This adjusting means may advantageously consist of a part retaining the wear component, this part being mounted so as to slide in the direction of displacement of the axis of rotation, in a groove provided in the frame, and being fixable in an adjustable position along the groove, by means of a removable fixing member.

BRIEF DESCRIPTION OF THE DRAWINGS

The invention will be understood more clearly from the detailed description of an embodiment illustrated by way of example in the attached drawings, in which.

DESCRIPTION OF PREFERRED EMBODIMENT

Figure 1:
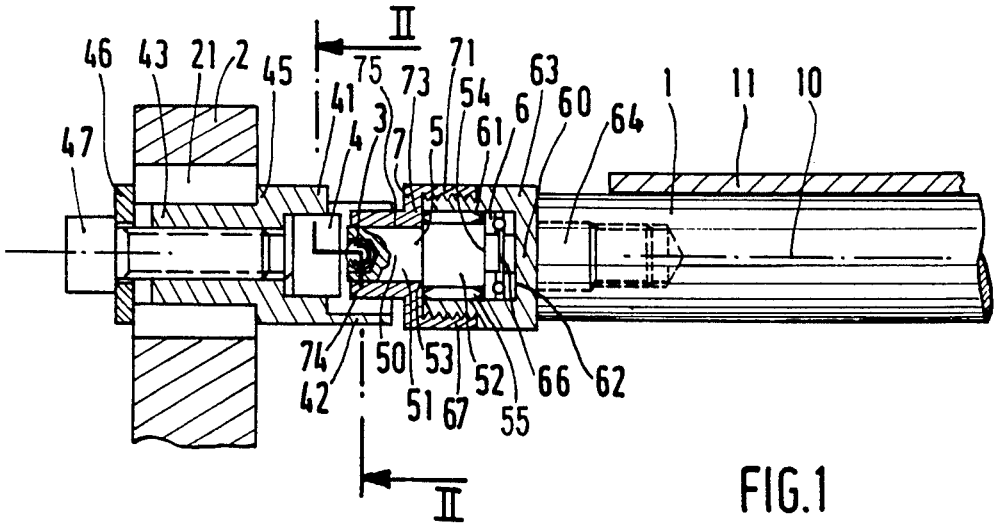
FIG. 1 is an axial section through a roller support bearing according to the invention.
Figure 2:
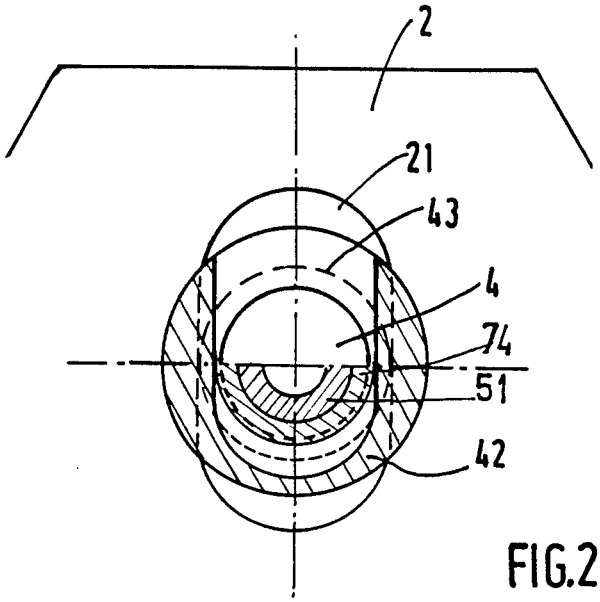
FIG. 2 is a section along the line II—II of FIG. 1.

FIG. 1 shows schematically the end of a roller 1 mounted for rotation about its axis 10, on a frame 2. The roller 1 may, for example, be a levelling roller over which a metal strip 11 passes at great speed. It is supported radially, in the conventional manner, by means (not shown) of, for example, supporting roller wheels positioned at regular intervals around its axis or a support roller located on the side opposite to the metal plate 11.

The roller 1 is provided, at each of its ends, with a contact ball bearing 3 which, depending on the axial stresses applied to the roller, may come to bear against a wear component 4 mounted on the frame 2.

The contact ball bearing 3 is seated on the end of a support piece 5 consisting of an insert 51 extended, on the roller side, by an enlarged base piece 52. The insert 51 and the base piece 52 are delimited by the cylindrical side surfaces centered about the same axis 50, which is aligned with the axis of rotation 10 of the roller. The base piece 52 has a diameter which is larger than that of the insert 51, so as to form a shoulder 53 between their side surfaces.

The enlarged base piece 52 fits inside a recess 6 defined laterally by a cylindrical wall 61 and, on the roller side, by an end wall 62 transverse to the axis. Preferably, the recess 6 is provided inside a part 63 forming the body of the axial bearing and fixed by a screw 64 to the end of the roller, such that the axis 60 of the insert 6 coincides with the axis 10 of the roller.

The base 52 of the support piece 5 is supported inside the recess 6, on the one hand, radially by a centering rolling bearing 55 located between the inner face 61 of the bowl 6 and the side face of the base piece 52 and, on the other hand, axially by an axial bearing 66 located between the end face 54 of the base piece 52 and the end wall 62 of recess 6. In this position, the shoulder 53 is located substantially in the plane of the end of the cylindrical side wall 61 of the recess.

The assembly is held in position by a cap 7 which closes the recess and comprises a bush 71 provided with an internal thread which screws onto a corresponding thread 67 provided on the side wall 61 of the recess 6. The cap 7 is closed by a flat end wall 73 provided with an orifice 75 through which the insert 50 passes and bearing against the shoulder 53 so as to keep the base piece 52 in position inside the recess. Advantageously, the orifice 75 through which the insert 51 passes consists of a bore provided along the axis of a cylindrical sleeve 74 which extends the cap 7, substantially as far as the end of the insert, the latter being inserted inside the axial bore 75 without, however, being fixed, such that the sleeve 74 forms a slide bearing co-operating with the rolling bearing 55 so as to keep the axis 50 of the ball aligned with the axis 10 of the roller, without preventing rotation of the insert 51 in relation to the sleeve 74.

Moreover, the wear plate 4 is mounted inside a support piece 41 which comprises a U-shaped extension 42 which is positioned below the sleeve 74. The extension 42 thus serves to support the roller 1 in the event of a stoppage, for example during disassembly.

Advantageously, the support piece 41 may be fixed in an adjustable position on the frame 2. For this purpose, the support piece 41 is provided with a stem 43 which slides inside an oblong hole or a groove 21 provided in the frame 2 and allowing the stem 43 to slide in a direction parallel to the direction in which the roller 1 bears against its support. The support piece 41 is fixed onto the frame 2 by a shoulder 45 and a washer 46 clamped by a bolt 47. In this way, in the event of the roller 1 becoming worn, causing its axis 10 to be displaced slightly, it is therefore possible to move the support piece 41, and hence the wearing plate 4, so that the contact ball bearing 3 remains perfectly centred in relation to the wearing plate 4.

It can be seen that, in the arrangement according to the invention, the revolving part of the bearing on which the ball 3 is fixed simply consists of the support piece 5 which has a very small inertia. When the roller 1 is driven at high speed, the support piece 5 and the ball 3 also revolve about the axis 10. However, in the event of pressure against the wear plate 4, rotation of the support piece 5 and of the ball 3 may be stopped very rapidly owing to the small inertia of the support piece which is centered by the rolling bearing 55 and which bears against the axial bearing 66.

In order to reduce as far as possible the inertia of the revolving parts, it is advantageous to use a needle roller bearing for centering of the support piece 5.

As a result of the small inertia of all the revolving parts, as well as the limited contact between the ball 3 which has a small diameter and the wear plate 4, it is possible to reduce the heat energy resulting from friction when the ball 3 bears against the wear plate 4.

Owing to this reduction in the amount of heat produced, it is possible to attain speeds of more than 12,000 rpm for rollers with a diameter of the order of 20 mm.

What is claimed is:

1. Device for axially maintaining a roller mounted in a fixed frame for rotation, with axial play, about an axis of said roller, said roller being merely radially maintained in working position and comprising a rotation shaft having two ends and being provided, at each said end, with an axially supporting device comprising a contact ball centered about said axis of rotation and adapted to contact a wear plate mounted on said fixed frame, wherein each said axially supporting device comprises (a) a recess provided at an end of said roller and delimited, on the roller side, by a transverse end wall and, on its periphery, by a cylindrical side wall;

(b) a support piece consisting of a cylindrical tip extended, on the roller side, by an enlarged base piece fitting inside said recess and having a diameter greater than that of said tip so as to form a shoulder between cylindrical side surfaces of said tip and of said enlarged base piece;

(c) said enlarged base piece bearing, in the axial direction, against said transverse end wall of said recess, by means of an axial bearing, and, in the radial direction, against said cylindrical side wall of said recess, by means of a rolling bearing centering said tip about said axis of rotation;

(d) a contact bearing ball seated on an end of said tip opposed to said enlarged base; and (e) a cap for holding the whole assembly in position, said cap being fixed onto said side wall of said tip for closing it and comprising a flat end wall provided with an orifice through which said tip passes and bearing, in the axial direction, against said shoulder formed between the cylindrical side surfaces of said tip and of said enlarged base piece.

2. Device according to claim 1, wherein said rolling bearing centering said enlarged base piece and located on said side wall of said recess is a needle roller bearing.

3. Device according to claim 1, wherein said cap comprises a bush provided with an internal thread capable of being screwed onto a corresponding thread on said side wall of said recess.

4. Device according to claim 1, in which said axis of rotation of said roller may be displaced, parallel to itself, inside said fixed frame, said fixed frame being provided, opposite each contact ball bearing, with a wear component said device comprising means for adjusting the position of said wear component on said frame, in accordance with the position of said axis of rotation of said roller.

5. Device according to claim 4, wherein said means for adjusting the position of said wear component comprises a part retaining said wear component which part is mounted so as to slide, in the direction of displacement of said axis of rotation, in a groove provided on said frame, and a removable member for fixing said retaining part in an adjustable position, along said groove.

* * * * *